US011542642B2

(12) United States Patent
Colosio et al.

(10) Patent No.: US 11,542,642 B2
(45) Date of Patent: Jan. 3, 2023

(54) METHOD FOR MAKING A KNITTING STITCH IN A KNITTING MACHINE WITH ONE OR MORE FEEDERS

(71) Applicant: JVC HOLDING SRL, Rezzato (IT)

(72) Inventors: Gianfranco Colosio, Botticino Sera (IT); Giuseppe Golin, Botticino Sera (IT); Paolo Lenzi, Castiglinoe delle Stiviere (IT)

(73) Assignee: JVC HOLDING SRL, Rezzato (IT)

( * ) Notice: Subject to any disclaimer, the term of this patent is extended or adjusted under 35 U.S.C. 154(b) by 78 days.

(21) Appl. No.: 17/257,891

(22) PCT Filed: Jul. 1, 2019

(86) PCT No.: PCT/EP2019/067527
§ 371 (c)(1),
(2) Date: Jan. 5, 2021

(87) PCT Pub. No.: WO2020/007764
PCT Pub. Date: Jan. 9, 2020

(65) Prior Publication Data

US 2021/0269951 A1 Sep. 2, 2021

(30) Foreign Application Priority Data

Jul. 6, 2018 (IT) ..... 102018000007018

(51) Int. Cl.

| | |
|---|---|
| ***D04B 9/02*** | (2006.01) |
| ***D04B 15/06*** | (2006.01) |
| ***D04B 15/32*** | (2006.01) |
| ***D04B 1/26*** | (2006.01) |

(52) U.S. Cl.
CPC ..... *D04B 9/02* (2013.01); *D04B 1/26* (2013.01); *D04B 15/06* (2013.01); *D04B 15/322* (2013.01)

(58) Field of Classification Search
CPC ..... D04B 9/02; D04B 15/06
USPC ..... 66/13, 217, 104, 107, 108 R
See application file for complete search history.

(56) References Cited

U.S. PATENT DOCUMENTS

| | | | | |
|---|---|---|---|---|
| 2,711,090 A * | 6/1955 | Marlette | ..... | D04B 9/34 66/108 A |
| 3,157,037 A * | 11/1964 | Nebel | ..... | D04B 1/26 66/178 R |
| 3,173,277 A * | 3/1965 | Fregeolle | ..... | D04B 9/02 66/108 A |

(Continued)

FOREIGN PATENT DOCUMENTS

| | | | | |
|---|---|---|---|---|
| EP | 0 466 072 A2 | 1/1991 | | |
| GB | 2182953 A * | 5/1987 | ..... | D04B 15/06 |

OTHER PUBLICATIONS

"Stitch." Lexico by Oxford. accessed May 13, 2022. https://www.lexico.com/en/definition/stitch (Year: 2022).*

(Continued)

*Primary Examiner* — Khoa D Huynh
*Assistant Examiner* — Grace Huang
(74) *Attorney, Agent, or Firm* — Troutman Pepper Hamilton Sanders LLP

(57) ABSTRACT

In the method for making a knitting stitch in a knitting machine where for forming the knitting stitch a needle and a sinker cooperate, the created knitting stitch is moved by a movement of the sinker to a rest position of the knitting stitch.

7 Claims, 3 Drawing Sheets

(56) References Cited

U.S. PATENT DOCUMENTS

| | | | | | |
|---|---|---|---|---|---|
| 5,477,707 | A * | 12/1995 | Renda | D04B 15/06 | 66/93 |
| 5,713,220 | A * | 2/1998 | Seino | D04B 15/06 | 66/106 |
| 6,321,575 | B1 * | 11/2001 | Sangiacomo | D04B 15/34 | 66/93 |
| 6,705,129 | B2 * | 3/2004 | Pot d'Or | D04B 9/12 | 66/93 |
| 7,152,436 | B2 * | 12/2006 | Wang | D04B 15/06 | 66/107 |
| 9,365,962 | B2 * | 6/2016 | Lonati | D04B 9/40 | |

OTHER PUBLICATIONS

International Search Report issued in corresponding International Patent Application No. PCT/EP2019/067527 dated Aug. 20, 2019.

* cited by examiner

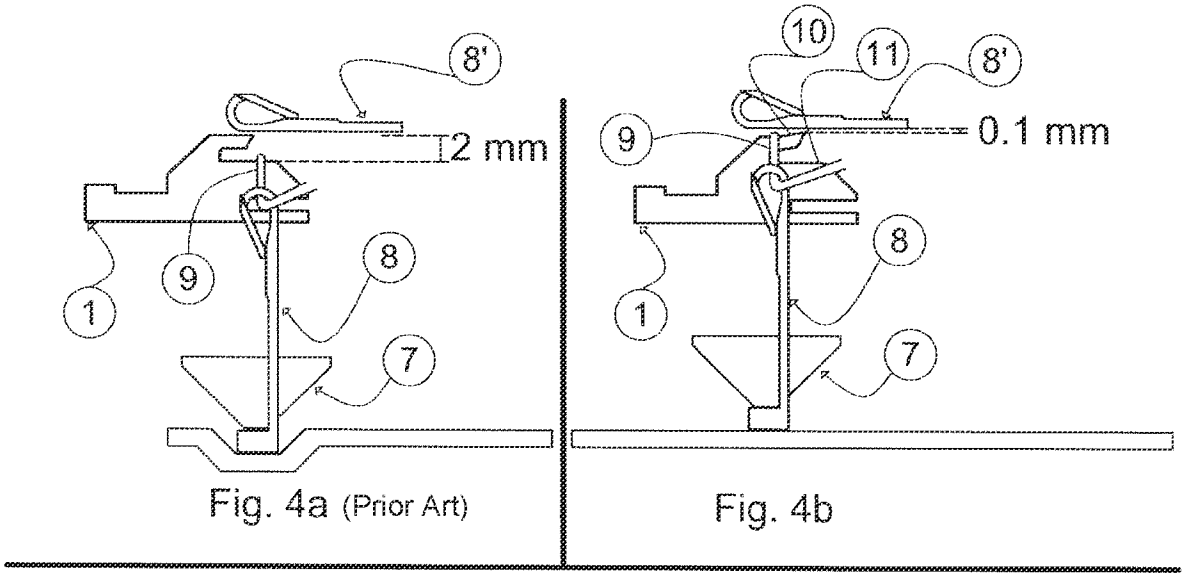
Fig. 4a (Prior Art)
Fig. 4b
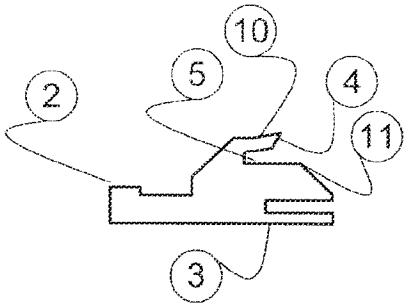
Fig. 1

METHOD FOR MAKING A KNITTING STITCH IN A KNITTING MACHINE WITH ONE OR MORE FEEDERS

CROSS REFERENCE TO RELATED APPLICATIONS

This is a U.S. National Phase Application under 35 U.S.C. § 371 of International Patent Application No. PCT/EP2019/067527, filed Jul. 1, 2019, which claims priority of Italian Patent Application No. 102018000007018, filed Jul. 6, 2018. The entire contents of which are hereby incorporated by reference.

FIELD OF THE INVENTION

The present invention relates to a method for making a knitting stitch in a knitting machine with one or more feeders, and can be applied in particular but not exclusively in the field of circular machines for making stockings or uppers for shoes.

BACKGROUND

The developments of new uppers for shoes on circular inlay machines have highlighted some critical issues due to the formation of the knitting stitch which has always provided for the movement of the needles upwards and downwards.

In particular, in a first step the needle moves downwards to form the knitting stitch with the yarn kept taut between the wall or knitting plane present on the sinker and the eye of the needle, and in a second step the needle moves upwards into a rest position of the knitting stitch where the tension of the knitting stitch is discharged and the sinker can hit the knitting stitch and hold it for subsequent processes.

It is inevitable that the needles not selected for processing on a subsequent feeder or the needles not selected for processing at a subsequent step on the same feeder still continue their upwards and downwards movement uselessly because they follow the same path as the cams on which the needles are working which on the contrary have been selected.

This continuous stress that persists on knitting stitches when the needles that created them are not working creates linear defects such as, for example, visible marks on the final product.

In a machine for stockings with only one feeder and only one stitch formation position these defects are only slightly highlighted, but in the case of machines for uppers this phenomenon is further accentuated by the use of yarns with various chemical/physical characteristics and the need to create very compact stitches in terms of elasticity which on the contrary is typical for products such as stockings. The technical specifications of machines for inlay uppers also cause further evidence of these defects as both their configuration with various feeders, and the work in alternate motion, contribute to creating different positions in which the unselected needles uselessly follow the upwards and downwards movement.

It can also be said that disadvantageously the processing of different areas of stitches on the different feeders with different types of knitting stitch density and different yarn sizes, inevitably leads to influencing the stitch already formed on a feeder and in the waiting position when another feeder proceeds with its formation. In other words, an area of stitch on a feeder can be formed with needles in a first position to then move into waiting; then passing to the formation of another area of stitch on another feeder, these needles could be positioned much lower, also forcing the needles of the first area of stitch that are waiting to be lowered in an inconvenient way, causing defects.

U.S. Pat. No. 3,173,277 discloses a method for making a knitting stitch.

SUMMARY

The technical task addressed by the present invention is accordingly to realize a method for making a knitting stitch in a knitting machine with one or more feeders that enables the decried technical drawbacks of the prior art to be eliminated.

Within the context of this technical task an object of the invention is that of realizing a method for making a knitting stitch in a knitting machine with one or more feeders that eliminates the marking defects due to the upwards and downwards movement of the unselected needles.

The technical task, as well as these and other objects, according to the present invention, are reached by providing a method for making a knitting stitch in a knitting machine wherein for forming the knitting stitch a needle and a sinker cooperate, characterized in that the created knitting stitch is moved by a movement of the sinker to a rest position.

In a preferred embodiment of the invention, a first wall or knitting plane is selected on the sinker where the knitting stitch is created and a second wall or knitting plane where the created knitting stitch is moved to said rest position.

Advantageously said first and second wall or knitting plane are positioned at different levels on the sinker.

In a preferred embodiment of the invention, the first wall or knitting plane is identified on at least one holding beak of the sinker.

In a preferred embodiment of the invention the knitting stitch is moved from the first wall or knitting plane to the second wall or knitting plane by selective movement of the sinker with respect to the needle.

The axial position of an unselected needle (bridle position) at a feeder therefore remains unchanged during the passage through it.

The present invention also discloses a knitting machine having a moving program for moving the needles and the corresponding sinkers to make knitting stitches according to the aforesaid method.

The knitting machine can consist of a circular or rectilinear machine to be used for making stockings or uppers for shoes.

BRIEF DESCRIPTION OF THE DRAWINGS

Further characteristics and advantages of the invention will more fully emerge from the description of a method for making a knitting stitch in a knitting machine with one or more feeders according to the invention, illustrated by way of non limiting example in the accompanying drawings, in which:

FIG. 1 shows a sinker that can be used in a knitting machine in compliance with the invention;

FIGS. 4*a* and 4*b* respectively show the different positions of the needles that perform the closure of flaps of the double collar of an upper for shoes, between a prior art example of traditional formation of a knitting stitch with movement into the rest position performed by the needle, and in an example of formation in compliance with the invention of a knitting stitch with movement into the rest position performed by the sinker.

DETAILED DESCRIPTION

Figures 2A, 2B:
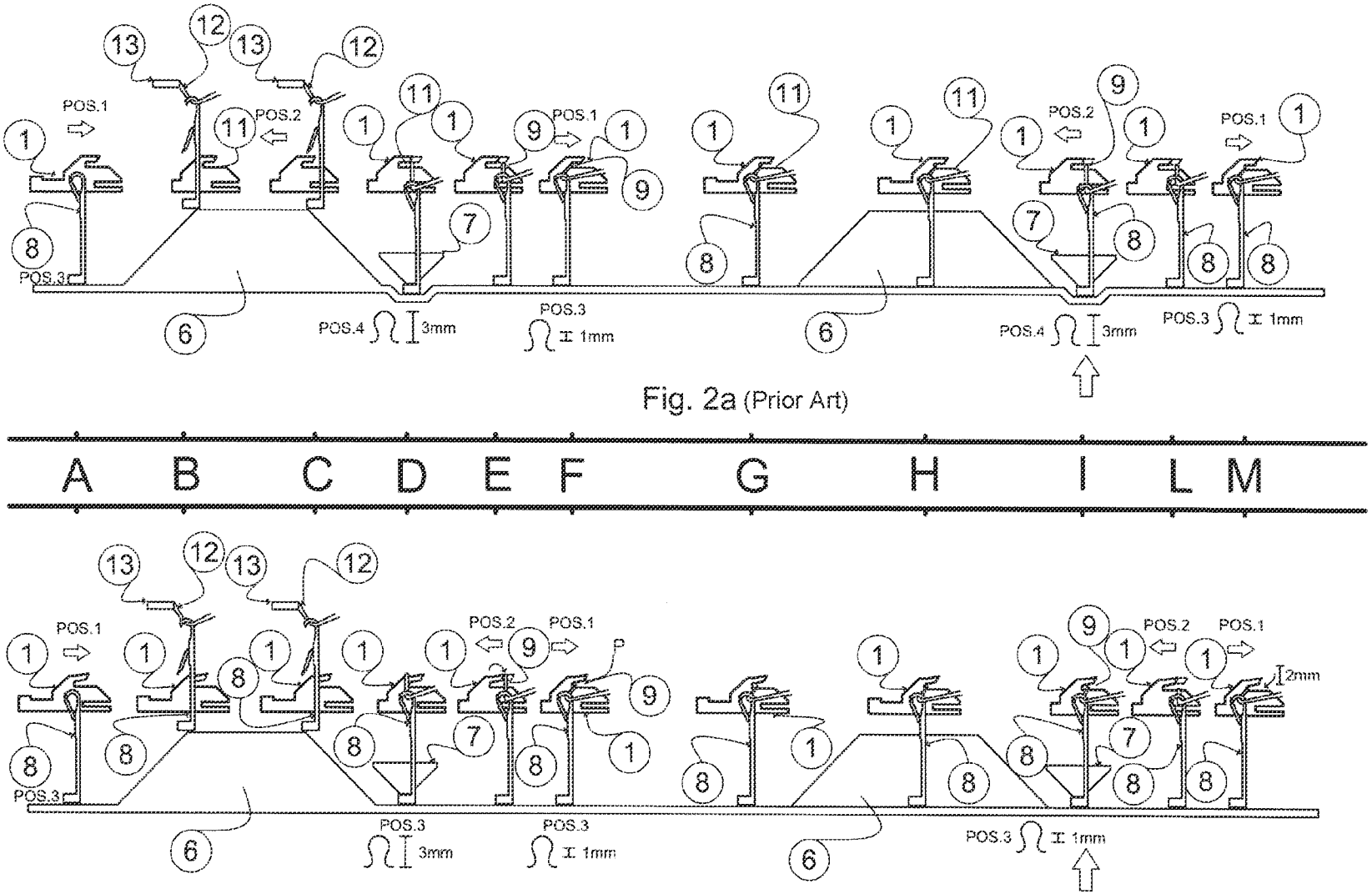
Fig. 2a (Prior Art)
FIGS. 2*a* and 2*b* respectively show the sequential steps of the movement of a needle through a feeder in which the needle has been selected and a subsequent feeder in which the needle has not been selected, in parallel in a machine programmed to operate in the prior art and respectively in a machine programmed to operate according to the method in compliance with the present invention.
Figure 3B:
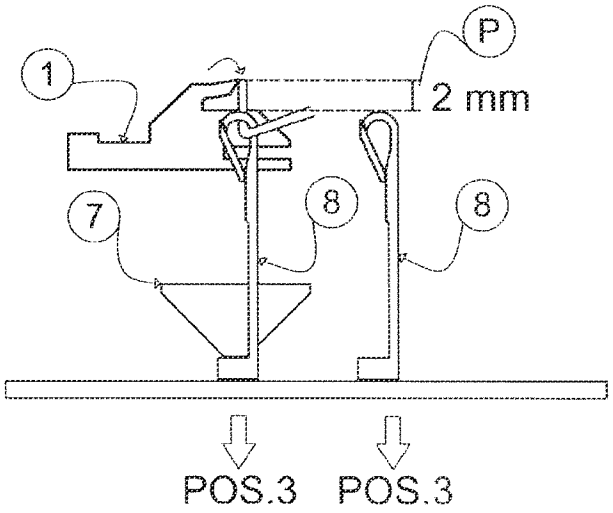
FIGS. 3*a* and 3*b* respectively show the rest position in a prior art example of traditional formation of a knitting stitch with movement into the rest position performed by the needle, and in an example of formation in compliance with the invention of a knitting stitch with movement into the rest position performed by the sinker.
Figure 3A:
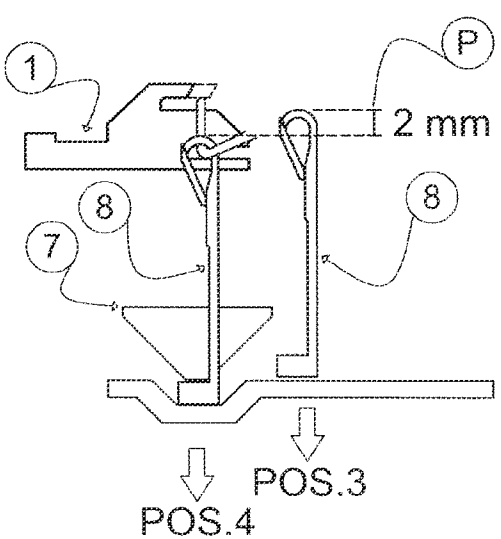
Fig. 3a (Prior Art)

With reference to the cited figures, a method for making a knitting stitch in a knitting machine with one or more feeders is shown.

Reference will be made below to a circular knitting machine comprising a rotating needle bed formed by a cylinder circumferentially having axial grooves for guiding the needles, a sinker crown, and one or more feeders on each of which a yarn guide (auto-striper) is mounted, for feeding the yarn to the needles in the formation of the stitch.

The sinkers 1 rotate solidly with the cylinder and are radially slidable to the cylinder and each cooperate with a corresponding needle 8 for the formation and knitting of the knitting stitch 9.

Each sinker 1 comprises an activation heel 2, a guide 3, a holding beak 4 and a groove 5 (see FIG. 1).

Finally, each feeder comprises a cam system for the activation of the needles 8 in the stitch, loop or bridle position.

In particular, an uphill cam 6 is provided for the selection of one of the positions and a knitting cam 7.

Obviously, the field of application also extends to a circular machine with a double needle bed or a rectilinear knitting machine.

The method of making the knitting stitch 9 envisages moving the created knitting stitch 9, by a movement of the sinker 1, into a rest position in which its tension is at least partially discharged.

In substance, a first wall or knitting plane 10 is selected on the sinker 1 where the knitting stitch 9 is created and a second wall or knitting plane 11 where the created knitting stitch 9 is moved to the rest position.

The first wall or knitting plane 10 and the second wall or knitting plane 11 are positioned at different levels on the sinker 1.

In particular the level where the first wall or knitting plane 10 is positioned is above the level where the second wall or knitting plane 11 is positioned.

The first wall or knitting plane 10 has a smooth profile, that is to say its profile may be flat or curved but free of sharp edges.

It was found to be convenient to create the knitting stitch 9 on a wall or knitting plane 10 of the sinker 1 that does not correspond at all to the wall or knitting plane traditionally identified on a sinker.

In fact, the first wall or knitting plane 10 where the knitting stitch 9 is now created is identified on the holding beak 4 of the sinker 1, while the second wall or knitting plane 11 that identifies the rest position of the knitting stitch 9 corresponds precisely to the wall or knitting plane that is traditionally used for the creation of the knitting stitch.

Advantageously, the knitting stitch 9 is moved from the first wall or knitting plane 10 to the second wall or knitting plane 11 by selective movement of the sinker 1 with respect to the needle 8.

Consequently, the axial position of an unselected needle 8 at a feeder remains unchanged during the passage of the knitting stitch 9 through the unselected needle 8.

With specific reference to FIGS. 2*a* and 2*b* it is possible to make a more detailed comparison between a traditional example of formation of a knitting stitch 9 with movement into the rest position performed by the needle 8, and an example of formation of a knitting stitch 9 with movement into the rest position performed by the sinker 1.

In the description that follows, corresponding parts will be denoted by the same reference number.

In the two examples being compared, the formation of a knitting stitch 9 is assumed with a length equal to 3 mm and a distance of 2 mm between the formation position of the knitting stitch 9 and the rest position of the knitting stitch 9.

In this hypothesis, in the method in compliance with the invention a sinker 1 is used having a distance equal to 2 mm between the first wall or knitting plane 10 and the second wall or knitting plane 11.

Reference is made to FIG. 2*a* which illustrates the traditional way of making the knitting stitch 9.

In step A the needle 8 is in position 3 (indicated as POS 3) and starts to rise to take the yarn 12, while the sinker 1 is in position 1 (indicated as POS 1) of advancement towards the center of the cylinder.

In step B the needle 8 is in the position to take the yarn 12 from the yarn guide 13 while the sinker 1 remains in position 1.

In step C the needle 8 has taken the yarn 12, while the sinker 1 comes into position 2 (indicated as POS 2) to start to create the knitting stitch 9 on the traditional wall or knitting plane 11.

In step D the needle 8 moves into position 4 (indicated as POS 4) and forms a 3 mm knitting stitch 9 that is equal to the distance from the eye of the needle 8 to the wall or knitting plane 11. The sinker 1 is in position 2 to create the knitting stitch 9 on the wall or knitting plane 11.

In step E the needle 8 rises again by 2 mm and comes into the rest position 3.

In step F the sinker 1 returns to position 1 to keep the knitting stitch 9 just constructed inside the groove 5 on the wall or knitting plane 11.

In steps G and H the needle 8 is selected on the second feeder.

In step I the knitting stitch 9 is maintained with the same tension as the previous feeder, due to the fact that the same distance of 3 mm is maintained from the eye of the needle 8 to the wall or knitting plane 11, with the result that the knitting stitch 9 previously made continues to be stressed.

In step L the needle 8 rises again by 2 mm and comes into the rest position 3.

In step M the sinker 1 returns to position 1 to keep the knitting stitch 9 inside the holding beak 4 on the wall or knitting plane 11.

Reference is made to FIG. 2*b* which illustrates a way of making a knitting stitch in compliance with the invention.

In step A the needle 8 is in position 3 and starts to rise to take the yarn 12, while the sinker 1 is in position 1 of advancement towards the center of the cylinder.

In step B the needle 8 is in the position to take the yarn 12 from the yarn guide 13 while the sinker 1 remains in position 1.

In step C the needle 8 has taken the yarn 12, while the sinker 1 remains in position 1.

In step D the needle 8 moves into position 3 and forms a 3 mm knitting stitch 9 that is equal to the distance from the eye of the needle 8 to the first knitting wall 10. In step E the sinker 1 moves into position 2, after creating the knitting stitch 9 on the first wall or knitting plane 10, and the knitting stitch 9 performs the rest position by lowering onto the second wall or knitting plane 11 positioned at a level 2 mm lower than the first wall or knitting plane 10.

In step F the sinker 1 returns to position 1 to keep the knitting stitch 9 just constructed inside the groove 5 on the second wall or knitting plane 11.

In steps G and H the needle 8 is selected on the second feeder.

In step I, the needle 8 is brought back below the tip of the knitting cam 7 but the 3 mm knitting stitch 9 is not stressed as it is not positioned on the first wall or knitting plane 10 where it was previously formed, rather on the second wall or knitting plane 11 positioned at a level 2 mm lower: in this way it is guaranteed that the needle 8 does not stress the knitting stitch 9 with a tolerance of 2 mm equal to the distance between the first wall or knitting plane 10 and the second wall or knitting plane 11. In the event of a variation of the length of the knitting stitch 9 formed at the subsequent feeder, it will therefore be possible on this subsequent feeder not to stress the knitting stitch 9 formed at the previous feeder if the length variation of the knitting stitch 9 created at the subsequent feeder does not increase by 2 mm with respect to the knitting stitch 9 created at the previous feeder. The needle 8 can therefore form a new knitting stitch 9 having a length of 5 mm without stressing the 3 mm knitting stitch 9 previously created.

The knitting machine operating according to the method compliant with the invention can as mentioned be a circular machine or a rectilinear machine and can be intended for the formation of a stocking or an upper of a shoe.

With reference to FIGS. 4*a* and 4*b* one of the advantages of performing the knitting stitch 9 directly on the holding beak 4 of the sinker 1 can be clearly appreciated.

When the double collar of an upper according to the teachings of the present invention (FIG. 4*b*) is made, the hook or radial needle 8' that performs the join of the flaps of the double collar can pass at a very near distance (e.g. 0.1 mm) from the wall or knitting plane 10 on the holding beak 4 of the sinker 1 where the knitting stitch 9 is performed, so that the joining chain of the flaps of the double collar has a very contained height and is not clearly visible.

On the contrary, when the double collar of an upper (FIG. 4*a*) is made in the traditional way, the hook or radial needle 8' that performs the join of the flaps of the double collar passes at a significant distance (e.g. 2.1 mm) from the wall or knitting plane 11 of the sinker 1 where the knitting stitch 9 is performed, so that the joining chain of the flaps of the double collar has a much greater height and is clearly visible.

In conclusion, by using a first wall or knitting plane on the sinker for the formation of the knitting stitch and moving the sinker so as to move the knitting stitch created into a rest position on a second wall or knitting plane of the sinker placed at a different level from the first wall or knitting plane, it is possible not to place the knitting stitch in tension when the needle that created it is not selected on the other feeders or when the needle that created it is not selected at the next step on the same feeder, as happens for example in the event of a movement inversion of the cylinder necessary for the formation of an inlay.

This allows the formation of annoying marks to be prevented which would be very visible on the final product.

To prevent the undesired slipping of the knitting stitch 9 from the first wall or knitting plane 10, the holding beak 4 can have a particular profile, e.g. its surface opposite the groove 5 which defines the first wall or knitting plane 10 can describe a ramp that in order to be overtaken requires a slight over-tensioning of the yarn. The method for making a knitting stitch in a knitting machine as conceived herein is susceptible to many modifications and variations, all falling within the scope of the invented concept; furthermore, all the details are replaceable by technically equivalent elements.

In practice the materials used, as well as the dimensions, can be any according to the needs and the state of the art.

The invention claimed is:

1. A method for making a knitting stitch in a knitting machine comprising the steps of:

forming the knitting stitch by having a needle and a sinker cooperate;

moving the knitting stitch by a movement of the sinker to a rest position on the sinker; and providing a first wall or knitting plane on the sinker where the knitting stitch is to be created and providing a second wall or knitting plane on the sinker, whereby the second wall or knitting plane defines said rest position, and are positioned at different levels on the sinker, wherein an axial position of the needle at one feed remains unvaried during a passage of the knitting stitch through the needle.

2. The method for making the knitting stitch in the knitting machine according to claim 1, wherein providing said first wall or knitting plane comprises the first wall or knitting plane being provided on at least one holding beak of said sinker.

3. The method for making the knitting stitch in the knitting machine according to claim 1, wherein moving the knitting stitch comprises moving the knitting stitch from the first wall or knitting plane to the second wall or knitting plane by selective movement of the sinker with respect to the needle.

4. The method for making the knitting stitch in the knitting machine according to claim 1, wherein the first wall or knitting plane has a smooth profile, either flat or curved but free of sharp edges.

5. A knitting machine comprising a computer program for moving the needle and the cooperating sinker to make knitting stitches with the method according to claim 1.

6. The knitting machine according to claim 5, wherein the knitting machine is a circular machine.

7. A method for making a knitting stitch using a knitting machine comprising a needle and a sinker in cooperation, the method of the knitting stitch comprising the steps of:

moving the knitting stitch to a rest position on the sinker;

providing one of a first wall or first knitting plane on the sinker;

providing one of a second wall or second knitting plane on the sinker, defining said rest position; and positioning one of the first wall or the first knitting plane at a different level on the sinker than the second wall or the second knitting plane, wherein an axial position of the needle at one feed remains unvaried during a passage of the knitting stitch through the needle.

* * * * *